US008870595B2

(12) United States Patent
Schmitt et al.

(10) Patent No.: US 8,870,595 B2
(45) Date of Patent: Oct. 28, 2014

(54) ELECTRICAL CONNECTOR ASSEMBLY HAVING AN RF ABSORBER

(75) Inventors: Matthew Ryan Schmitt, Middletown, PA (US); Robert Harrison Wertz, Jr., Mechanicsburg, PA (US); Michael James Weiss, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 113 days.

(21) Appl. No.: 13/556,665

(22) Filed: Jul. 24, 2012

(65) Prior Publication Data

US 2014/0030922 A1 Jan. 30, 2014

(51) Int. Cl.
*H01R 13/648* (2006.01)

(52) U.S. Cl.
USPC ..... 439/607.25; 439/939

(58) Field of Classification Search
CPC ..... H01R 13/65802; H01R 23/6873; H01R 23/688; H01R 23/7073
USPC ..... 439/108, 541.5, 607.01, 607.17, 439/607.18, 607.21, 607.25, 939
See application file for complete search history.

(56) References Cited

U.S. PATENT DOCUMENTS

| | | | | |
|---|---|---|---|---|
| 7,249,966 | B2 * | 7/2007 | Long | 439/541.5 |
| 7,575,471 | B2 * | 8/2009 | Long | 439/541.5 |
| 7,641,515 | B1 * | 1/2010 | Szczesny et al. | 439/607.01 |
| 7,704,097 | B1 * | 4/2010 | Phillips et al. | 439/607.01 |
| 7,871,294 | B2 * | 1/2011 | Long | 439/541.5 |
| 8,277,252 | B2 * | 10/2012 | Fogg et al. | 439/607.25 |
| 8,469,738 | B2 * | 6/2013 | Long | 439/541.5 |
| 8,545,267 | B2 * | 10/2013 | Fogg et al. | 439/607.25 |
| 8,545,268 | B2 * | 10/2013 | Fogg et al. | 439/607.25 |

* cited by examiner

*Primary Examiner* — Thanh Tam Le

(57) ABSTRACT

An electrical connector assembly is provided with a shielding cage member having an upper port and a lower port configured to receive pluggable modules therein. The cage member has side walls that extend along sides of the upper and lower ports. The cage member includes a separator member that extends between the side walls and between the upper and lower ports. The separator member has an upper plate and a lower plate with a channel therebetween. A light pipe organizer is positioned within the channel. An RF absorber is positioned within the channel in engagement with the light pipe organizer. The RF absorber reduces an amount of electromagnetic interference (EMI) emitted from the channel.

13 Claims, 12 Drawing Sheets

ELECTRICAL CONNECTOR ASSEMBLY HAVING AN RF ABSORBER

BACKGROUND OF THE INVENTION

The subject matter herein relates generally to electronic connector assemblies and, specifically, to connector systems for pluggable electronic modules.

Various types of fiber optic and copper based electrical connector assemblies that permit communication between host equipment and external devices are known. These electrical connector assemblies typically include a pluggable module that is received within a receptacle assembly, which includes a receptacle connector that pluggably connects to the pluggable module. The receptacle assembly typically includes a metal cage having an internal compartment that receives the pluggable module therein. The receptacle connector is held in the internal compartment of the cage for connection with the pluggable module as the pluggable module is inserted therein.

One particular concern regarding such electrical connector assemblies is reducing electromagnetic interference (EMI) emissions. Due to government regulations, there is a need not only to minimize the EMI emissions of the electrical connector assembly, but also to contain the EMI emissions of the host system in which the electrical connector assembly is mounted, regardless of whether a pluggable module is plugged in to the receptacle. In conventional designs, EMI shielding is achieved using the metal cage. However, due to increasing signal speeds being transmitted through the electrical connector assemblies, the EMI shielding provided by conventional cages is proving to be inadequate.

There is a need for an electrical connector assembly having a reduced amount of EMI emissions.

BRIEF DESCRIPTION OF THE INVENTION

In one embodiment, an electrical connector assembly is provided with a shielding cage member having an upper port and a lower port configured to receive pluggable modules therein. The cage member has side walls that extend along sides of the upper and lower ports. The cage member includes a separator member that extends between the side walls and between the upper and lower ports. The separator member has an upper plate and a lower plate with a channel therebetween. A light pipe organizer is positioned within the channel. An RF absorber is positioned within the channel in engagement with the light pipe organizer. The RF absorber reduces an amount of electromagnetic interference (EMI) emitted from the channel.

In another embodiment, an electrical connector assembly includes a shielding cage member having an upper port and a lower port configured to receive pluggable modules therein. The cage member has side walls that extend along sides of the upper and lower ports. The cage member includes a separator member that extends between the side walls and between the upper and lower ports. The separator member has an upper plate and a lower plate with a channel therebetween. A light pipe is held by the cage member such that the light pipe is received within the channel. The light pipe includes an end. A light pipe organizer is positioned within the channel. The end of the light pipe is held by the light pipe organizer. The light pipe organizer includes an RF absorber material that reduces an amount of electromagnetic interference (EMI) emitted from the channel.

In another embodiment, an electrical connector assembly includes a shielding cage member having an upper port and a lower port configured to receive pluggable modules therein. The cage member has side walls that extend along sides of the upper and lower ports and a separator member that extends between the side walls between the upper and lower ports. The separator member has an upper plate and a lower plate with a channel therebetween. A receptacle connector is received in the cage member. The receptacle connector is accessible through the upper port and the lower port and is configured to be electrically connected to the pluggable modules. An RF absorber is positioned within the channel. The RF absorber reduces an amount of electromagnetic interference (EMI) emitted from the channel. The RF absorber includes a U-shaped body that is defined by first and second sheets that are interconnected at a bend wall.

DETAILED DESCRIPTION OF THE INVENTION

Figure 1:
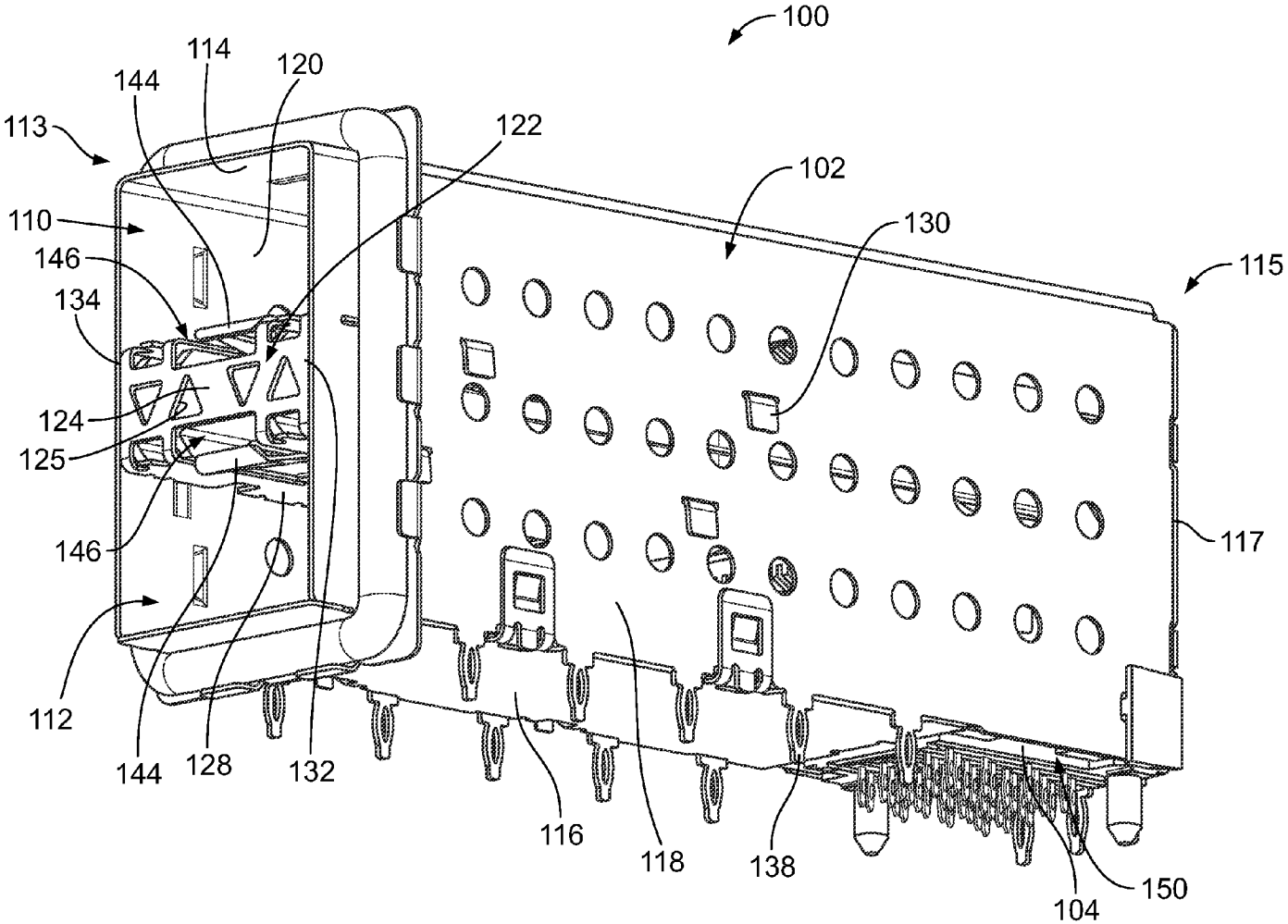
FIG. 1 is a front perspective view of an exemplary embodiment of an electrical connector assembly showing a cage member and a receptacle connector.

FIG. 1 is a front perspective view of an exemplary embodiment of an electrical connector assembly 100. The electrical connector assembly 100 includes a shielding cage member 102 and a receptacle connector 104 received in the cage member 102. Pluggable modules 106 (FIG. 13) are configured to be loaded into the cage member 102 for mating with the receptacle connector 104. The receptacle connector 104 is intended for placement on a circuit board, such as, but not limited to, a motherboard. The receptacle connector 104 is arranged within the cage member 102 for mating engagement with the pluggable modules 106.

The cage member 102 includes a plurality of walls that define multiple ports 110 and 112 for receipt of the pluggable modules 106. The port 110 defines an upper port positioned above the port 112 and may be referred to hereinafter as upper port 110. The port 112 defines a lower port positioned below the port 110 and may be referred to hereinafter as lower port 112. Any number of ports may be provided in alternative embodiments. In the exemplary embodiment, the cage member 102 includes the ports 110 and 112 arranged in a single column. But, the cage member 102 may include multiple columns of ports 110 and 112 in alternative embodiments. The cage member 102 may include any number of ports, arranged in any number of rows and/or columns, for receiving any number of pluggable modules 106. The cage member 102 may be a stamped and formed cage member.

The cage member 102 extends from a front 113 to a rear 115. The ports 110 and 112 are open through the front 113 of the cage member 102. The cage member 102 includes a top wall 114, a lower wall 116, a rear wall 117, and side walls 118 and 120, which together define the general enclosure for the cage member 102. The cage member 102 includes a separator member 122 that subdivides the cage member 102 into the upper port 110 and the lower port 112. The separator member 122 extends between the side walls 118 and 120. The separator member 122 has a front wall 124 with an upper plate 126 (FIGS. 3, 4, and 6) and a lower plate 128 extending rearward from the front wall 124. The separator member 122 may include one or more light pipe openings 125 that extend through the front wall 124. The separator member 122 is retained in place by tabs 130, which extend from side edges 132 and 134 of the plates 126 and 128, and which extend through the side walls 118 and 120. Although two are shown, the separator member 122 may include any number of light pipe openings 125.

The cage member 102 has numerous features allowing the grounding of the cage member 102 to a motherboard and/or a further panel. The lower wall 116 and the side walls 118 and 120 include press fit pins 138 extending therefrom that are configured to be received in plated ground vias of the motherboard to electrically ground the cage member 102 to the ground plane of the motherboard. The press fit pins 138 are profiled to both mechanically hold the cage member 102 to the motherboard as well as to ground the cage member 102 thereto. The lower wall 116 may include similar press fit pins or other features to provide grounding of the cage member 102 to the motherboard. Around the perimeter of the cage member 102 towards the front edge thereof, the cage member 102 may include a plurality of resilient tabs (not shown) profiled to engage an edge of an opening (not shown) through which the cage member 102 is inserted, for example such as an opening in a panel (not shown) or chassis (not shown).

The separator member 122 includes latches 144 adjacent a front edge thereof for securing the pluggable module 106 to the cage member 102. The latches 144 are resilient beams that are formed in portions of the plates 126 and 128 by a stamping operation. Clearances 146 are formed around portions of the latches as a result of the stamping operation.

The lower wall 116 includes an opening 150 extending therethrough. The receptacle connector 104 is received in the opening 150. The receptacle connector 104 is accessible through the lower port 112 and the upper port 110. The separator member 122 does not extend to the rear wall 117, but rather stops short of the rear wall 117 to provide a space for the receptacle connector 104 to be loaded into the upper port 110.

Figure 2:
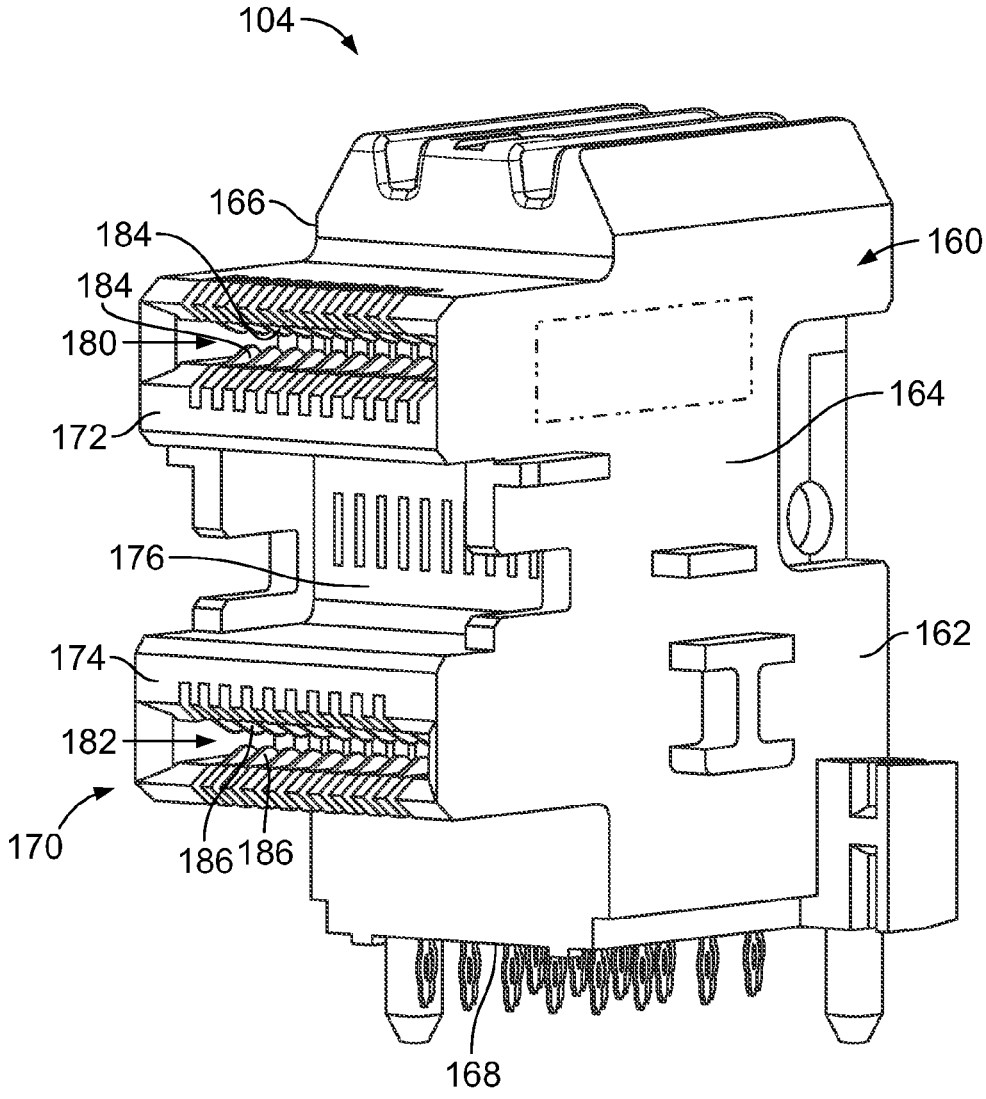
FIG. 2 is a front perspective view of the receptacle connector shown in FIG. 1.

FIG. 2 is a front perspective view of the receptacle connector 104. The receptacle connector 104 includes a housing 160 defined by an upstanding body portion 162. The body portion 162 includes side walls 164 and 166, a lower face 168 configured to be mounted to the motherboard, and a mating face 170. Upper and lower extension portions 172 and 174, respectively, extend from the body portion 162 to define the mating face 170. A recessed face 176 is defined between the upper extension 172 and the lower extension 174 at the front face of the body portion 162.

Figure 13:
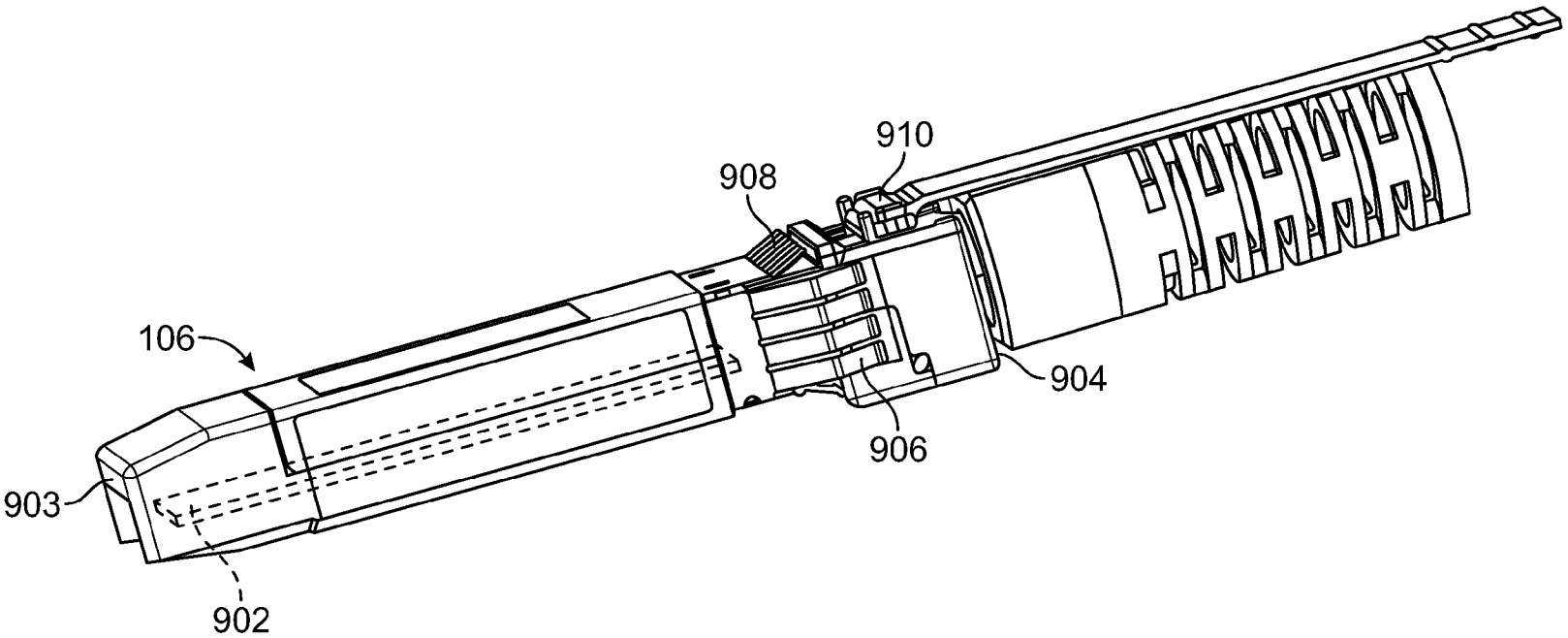
FIG. 13 is a perspective view of a pluggable module that may be used with the electrical connector assemblies shown and/or described herein.

Circuit card receiving slots 180 and 182 extend inwardly from the mating face 170 of each of the upper and lower extensions 172 and 174, respectively. The circuit card receiving slots 180 and 182 also extend inwardly to the housing body 160. Each of the circuit card receiving slots 180 and 182 is configured to receive a card edge of a corresponding pluggable module 106 (FIG. 13). A plurality of contacts 184 are held by the housing 160 and are exposed within the circuit card receiving slot 180 for mating with the corresponding pluggable module 106. The contacts 184 extend from the lower face 168 and are terminated to the motherboard. For example, the ends of the contacts 184 may constitute pins that are loaded into plated vias of the motherboard. Alternatively, the contacts 184 may be terminated to the motherboard in another manner, such as by surface mounting to the motherboard. A plurality of contacts 186 are held by the housing 160 and are exposed within the circuit card receiving slot 182 for mating with the corresponding pluggable module 106. The contacts 186 extend from the lower face 168 and are terminated to the motherboard.

Figure 3:
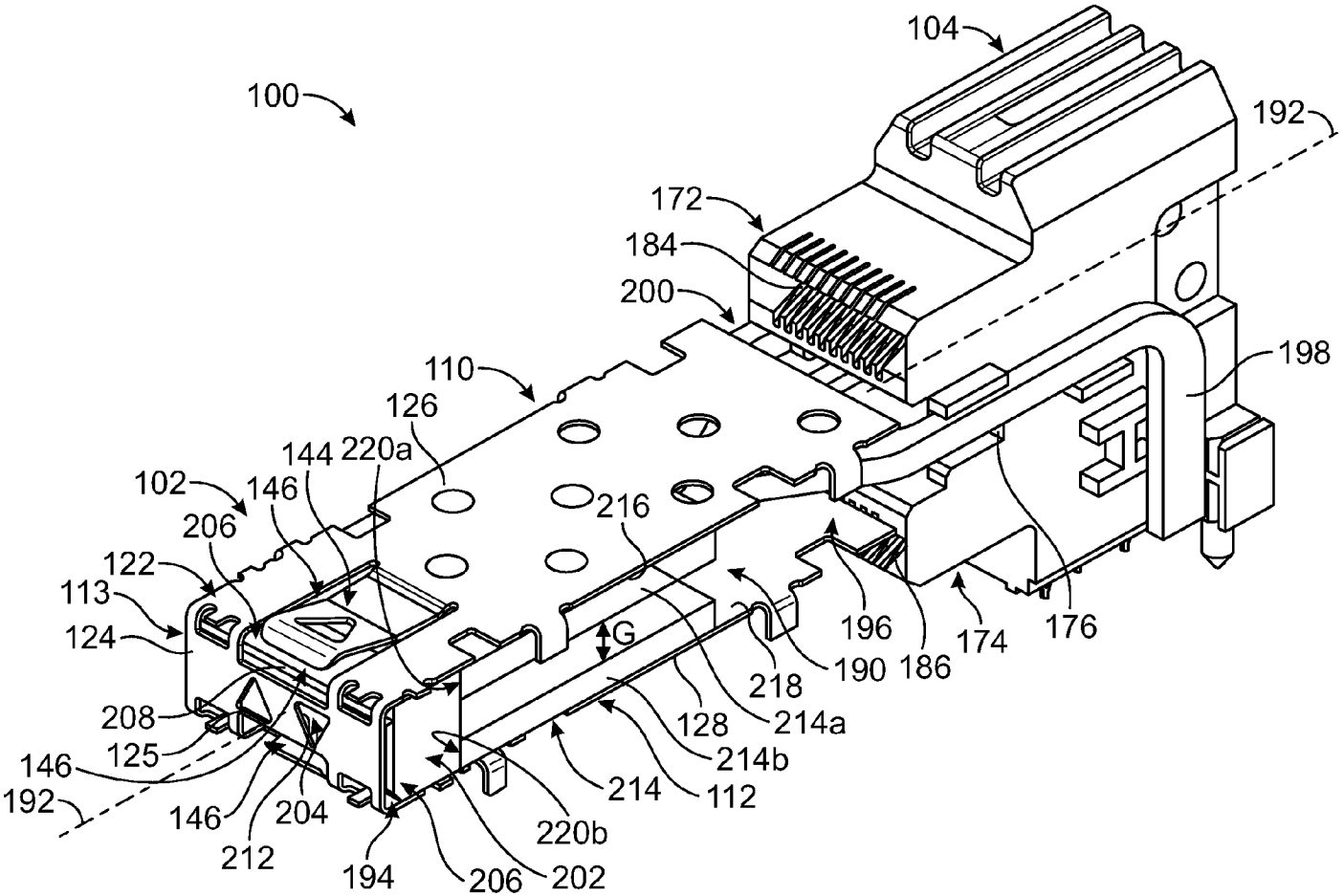
FIG. 3 is a perspective view of a portion of the electrical connector assembly shown in FIG. 1.
Figure 4:
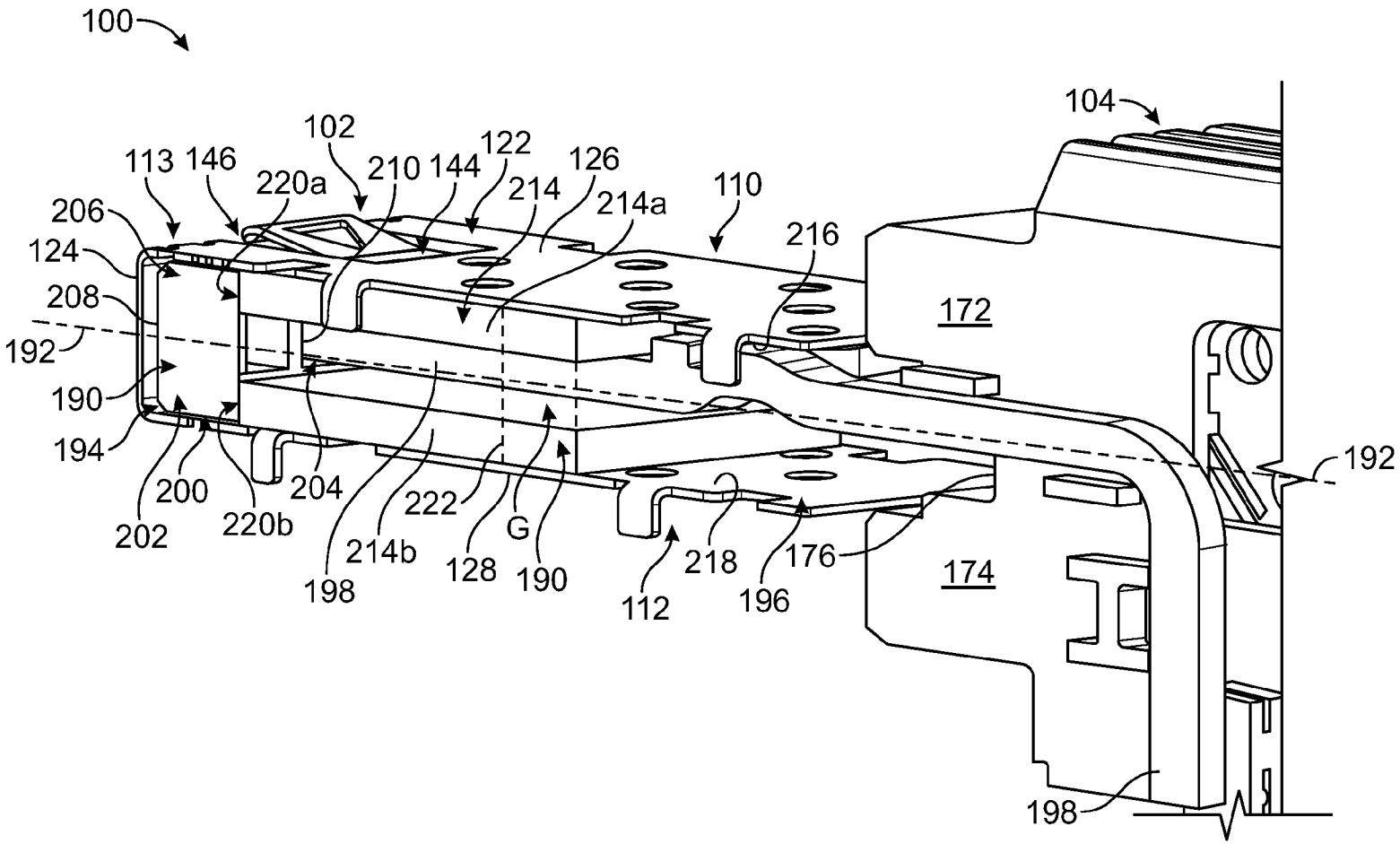
FIG. 4 is a perspective view of the portion of the electrical connector assembly shown in FIG. 3 viewed from a different angle than FIG. 3.

FIG. 3 is a perspective view of a portion of the electrical connector assembly 100. FIG. 4 is a perspective view of the portion of the electrical connector assembly 100 shown in FIG. 3 viewed from a different angle than FIG. 3. FIGS. 3 and 4 illustrate the spatial relationship between the separator member 122 and the receptacle connector 104 when the receptacle connector 104 is loaded into the cage member 102. The remainder of the cage member 102, besides the separator member 122, is not shown in FIGS. 3 and 4 for clarity.

The upper and lower extension portions 172 and 174, respectively, of the receptacle connector 104 are aligned within the upper and lower ports 110 and 112, respectively. The separator member 122 is aligned with the recessed face 176 of the receptacle connector 104. The contacts 184 and 186 (not visible in FIG. 4) of the receptacle connector 104 exhibit antenna characteristics and radiate energy when the contacts 184 and 186 are excited with energy, for example during signal transmission. Such energy is radiated through the cage member 102, including through the separator member 122.

The separator member 122 includes a channel 190 defined between the upper plate 126 and the lower plate 128. The upper plate 126 and the lower plate 128 are spaced apart to define the channel 190 therebetween. The channel 190 extends a length along a longitudinal axis 192 generally from the receptacle connector 104 to the front wall 124 of the separator member 122. Specifically, the channel 190 extends the length from a front end 194 to a rear end 196. The front end 194 of the channel 190 is positioned at the front 113 of the cage member 102. The channel 190 is open at the rear end 196.

The latches 144 may be at least partially deflected into the channel 190 when the pluggable modules 106 (shown in FIG. 13) are loaded into the ports 110 and 112. Portions of the pluggable modules 106 may be at least partially received in the channel 190 when the pluggable modules 106 are loaded into the ports 110 and 112. The channel 190 defines a space into which the latches 144 and/or portions of the pluggable modules 106 may extend into during use. The space defined by the channel 190 may also receive one or more light pipes 198.

In the exemplary embodiment, the electrical connector assembly 100 includes a light pipe assembly 200. The light pipe assembly 200 includes one or more of the light pipes 198 and a light pipe organizer 202. Each light pipe 198 includes an end 204. The light pipes 198 are received in the channel 190 of the separator member 122. Specifically, the light pipes 198 are routed from the receptacle connector 104 through the channel 190 to the front wall 124 of the separator member 122. As can be seen in FIG. 3, the ends 204 of the light pipes 198 are positioned at the front wall 124 of the separator member 122 in alignment with the corresponding light pipe openings 125. Although two are shown, the light pipe assembly 200 may include any number of light pipes 198.

The light pipe organizer 202 includes a body 206 having a front face 208. The body 206 includes one or more chambers 210 (not visible in FIG. 3) that receive the ends 204 of one or more corresponding light pipes 198 therein. In the exemplary embodiment, the body 206 includes a single chamber 210 that receives the end 204 of two light pipes 198 therein. But, the body 206 may include any number of chambers 210, wherein each chamber 210 may receive the end 204 of any number of light pipes 198. For example, in some embodiments, the body 206 includes a dedicated chamber for each light pipe 198 of the light pipe assembly 200.

The light pipe organizer 202 includes one or more light pipe openings 212 (not visible in FIG. 4) that extend through the front face 208 into the chamber 210. The light pipes 198 are held by the light pipe organizer 202 such that the end 204 of each light pipe 198 is held within a corresponding light pipe opening 212 of the light pipe organizer 202. The light pipe organizer 202 may include any number of light pipe openings 212, wherein each light pipe opening 212 may hold any number of light pipes 198.

The light pipe organizer 202 is positioned within the channel 190 at the front end 194. The light pipe openings 212 of the light pipe organizer 202 are aligned with the light pipe openings 125 that extend through the front wall 124 of the separator member 122, as can be seen in FIG. 3. Accordingly, the end 204 of each light pipe 198 is aligned with the corresponding light pipe opening 125 of the separator member 122 such that the light pipes 198 are configured to emit light through the openings 125.

The light pipe assembly 200 transmits light that may originate from one or more light emitting diodes (LEDs, not shown) on the motherboard mounted proximate to the receptacle connector 104. The light is transmitted by the light pipes 198 from the LEDs to the front 113 of the cage member 102, wherein the light is visible to an operator. The light may indicate a condition of the electrical and/or optical connection between the pluggable module 106 (FIG. 13) and the receptacle connector 104. The condition may relate to a quality of transmission between the pluggable module 106 and the receptacle connector 104. For example, the status indication may be a colored light (e.g., green for high quality transmission, red for poor transmission or to indicate a disconnection). The status indication may be a light that flashes or blinks at a predetermined frequency.

In some alternative embodiments, the electrical connector 100 does not include the light pipe assembly 200. In other alternative embodiments, the electrical connector 100 includes the light pipe assembly 200 but no light pipes 198 extend within the channel 190.

The receptacle connector 104 generates electric fields which are propagated through the cage member 102. The electric fields are propagated in the general direction of the longitudinal axis 192 of the channel 190 of the separator 122. The energy is propagated down the channel 190 along the longitudinal axis 192 toward the front wall 124 of the separator member 122. The contacts 184 and 186 are one source of such electric fields, which are radiated outward and along the channel 190. The walls 114, 116, 117, 118, and 120 (FIG. 1) of the cage member 102, being metal, serve to stop most electromagnetic interference (EMI) leakage from the cage member 102. However, there are portions of the cage member 102 which are susceptible to EMI leakage. For example, EMI leakage may exist at the front wall 124 of the separator member 122 where the light pipe openings 125 extend through the front wall 124. Moreover, and for example, EMI leakage may occur at the latch clearances 146 and/or at one or more seams between the separator member 122 and the side walls 118 and/or 120 of the cage member 102. The EMI propagates through the channel 190 and leaks through such areas. In the exemplary embodiment, the electrical connector assembly 100 includes one or more RF absorbers 214 positioned within the channel 190 to reduce or even eliminate EMI leakage from the channel 190.

The RF absorber 214 is manufactured from an EMI absorbent material and reduces the amount of energy propagated through the cage member 102, particularly through the channel 190 and the walls defining the channel 190. The RF absorber 214 reduces an amount of EMI emitted from the channel 190, such as, but not limited to, at the front wall 124 of the separator member 122 where the light pipe openings 125 extend through the front wall 124, at the latch clearances 146, and/or at one or more seams between the separator member 122 and the side walls 118 and/or 120 of the cage member 102. In some embodiments, the RF absorber 214 eliminates substantially all EMI leakage from the channel 190. The RF absorber 214 is manufactured from a material having a high relative permeability to absorb EMI and limit the total radiated power from the channel 190. The RF absorber 214 effectively increases the impedance of the channel 190, reflecting some energy upon entry of the energy into the channel 190, and absorbing the energy that penetrates the channel 190. The RF absorber 214 reduces energy reflections off of the conductive ground planes defined by the plates 126 and 128. The efficiency of the RF absorber 214 may depend on the formulation and application (e.g., thickness, relative permeability, size, location, and/or the like) of the RF absorber 214.

The RF absorber 214 may have a variety of different structures, configurations, sizes, shapes, and/or the like. In the exemplary embodiment, the RF absorber 214 includes two sheets 214*a* and 214*b*. The positioning of the RF absorber 214 within the channel 190 may be selected to control the amount of EMI reduction. In the exemplary embodiment, the sheets 214*a* and 214*b* extend on the upper plate 126 and the lower plate 128, respectively, of the separator member 122. Specifically, the RF absorber sheets 214*a* and 214*b* extend on interior faces 216 and 218 of the upper and lower plates 126 and 128, respectively. The sheets 214*a* and 214*b* include ends 220*a* and 220*b*, respectively, that are engaged with the body 206 of the light pipe organizer 202, as can be seen in FIGS. 3 and 4. The sheets 214*a* and 214*b* extend from the respective ends 220*a* and 220*b*, toward the rear end 196 of the channel 190. Because the ends 220*a* and 220*b* are engaged with the body 206 of the light pipe organizer 202, the sheets 214*a* and 214*b* extend from the body 206 of the light pipe organizer 202 toward the rear end 196 of the channel 190. As can be seen in FIGS. 3 and 4, the sheets 214*a* and 214*b* extend along the upper plate 126 and the lower plate 128, respectively, rearward of the corresponding latch clearance 146. The RF absorber sheets 214*a* and/or 214*b* may be positioned in different locations in alternative embodiments. For example, the sheets 214*a* and/or 214*b* may be positioned within the channel 190 on the side walls 118 and/or 120.

The ends 220*a* and/or 220*b* of the respective RF absorber sheets 214*a* and 214*b* are optionally adhered to the body 206 of the light pipe organizer 202, such as, but not limited to, using any adhesive, using an adhesive backing on the ends 220*a* and/or 220*b*, and/or the like. Alternative securing means may be used in alternative embodiments to secure the ends 220*a* and/or 220*b* to the body 206 of the light pipe organizer 202. In some embodiments, the ends 220*a* and/or 220*b* are not adhered or otherwise secured to the body 206 of the light pipe organizer 202, but rather are merely engaged with the body 206 of the light pipe organizer 202.

In the exemplary embodiment, the RF absorber sheets 214*a* and 214*b* extend generally parallel to the longitudinal axis 192 and the direction of electric field propagation from the receptacle connector 104. The sheets 214*a* and 214*b* thus extend generally parallel to the direction of propagation of the energy through the channel 190. The RF absorber sheets 214*a* and 214*b* thus constitute surface wave absorbers, which are oriented parallel to the direction of EMI propagation. Each sheet 214*a* and 214*b* may be referred to herein as a "first sheet" and/or a "second sheet". Although two are shown, the RF absorber 214 may include any number of the sheets. For example, in some alternative embodiments, the RF absorber 214 includes only a single RF absorber sheet (e.g., the sheet 214*a* or the sheet 214*b*). Moreover, and for example, in some alternative embodiments, the RF absorber 214 includes three or more RF absorber sheets.

The thickness of the RF absorber sheets 214*a* and 214*b* may be selected to control the amount of EMI reduction. For example, different thicknesses of the sheets 214*a* and 214*b* may be used to target energy at different frequencies. In the exemplary embodiment, the sheets 214*a* and 214*b* have thicknesses such that the sheets 214*a* and 214*b* are separated within the channel 190 by a gap G. The gap G may provide a space for the light pipes 198 to extend within the channel 190 and/or may provide an airflow path through the channel 190. Exemplary thicknesses of the sheets 214*a* and 214*b* include, but are not limited to, between approximately 1 mm and approximately 5 mm.

The RF absorber sheets 214*a* and 214*b* may occupy any amount of the total volume of the channel 190, such as, but not limited to, less than approximately half of the total volume of the channel 190, less than approximately 10% of the total volume of the channel 190, and/or the like. Alternatively, in embodiments wherein air flow is not a consideration and no light pipes 198 extend within the channel 190, the sheets 214*a* and 214*b* may occupy the entire volume of the channel 190. Moreover, in some alternative embodiments, the RF absorber 214 is positioned within the channel 190 to substantially or entirely fill an area of the channel 190, such as, but not limited to, the area identified as area 222 (not labeled in FIG. 3), thus functioning as a plug. The area 222 may be positioned at a different location along the channel 190 in other embodiments. The area 222 may be longer or shorter in other embodiments, filling a larger or smaller volume of the channel 190. In such cases where the RF absorber 214 is used as a plug, the light pipes 198 would not be used or would be rerouted within the cage member 102 to allow the RF absorber 214 to be positioned in such area 222. For example, the RF absorber 214 may be molded around the light pipes 198 and fill the area of the channel 190, but still allow the light pipes 198 to pass therethrough.

The RF absorber 214 may be manufactured from various materials, such as, but not limited to, rubber, nitrile, silicon, Viton® fluoroelastomer, neoprene, Hypolan® elastomer, urethane, an elastomeric material, and/or the like. The RF absorber 214 may have magnetic fillers included within an elastomeric material, such as, but not limited to, a carbonyl iron powder, an iron silicide, other magnetic fillers, and/or the like. The type of material within the RF absorber 214 may be selected to target EMI at different frequencies. In some embodiments, the RF absorber 214 includes a Q-Zorb™ material, commercially available from Laird Technologies.

Optionally, the RF absorber sheets 214*a* and/or 214*b* are adhered to the respective interior face 216 and 218 of the respective plate 126 and 128, such as, but not limited to, using any adhesive, using an adhesive backing on the sheets 214*a* and/or 214*b*, and/or the like. Alternative securing means may be used in alternative embodiments to secure the sheets 214*a* and/or 214*b* to the respective plate 126 and 128. In some embodiments, the sheets 214*a* and/or 214*b* are not adhered or otherwise secured to the respective interior face 216 and 218, but rather are merely engaged with the respective interior face 216 and 218. In other embodiments, the sheets 214*a* and/or 214*b* are not adhered, otherwise secured, or engaged with the respective interior face 216 and 218.

The RF absorber sheets 214*a* and/or 214*b* are optionally adhered to the light pipes 198, such as, but not limited to, using any adhesive, using an adhesive backing on the sheets 214*a* and/or 214*b*, and/or the like. Alternative securing means may be used in alternative embodiments to secure the sheets 214*a* and/or 214*b* to the light pipes 198. In some embodiments, the sheets 214*a* and/or 214*b* are not adhered or otherwise secured to the light pipes 198, but rather are merely engaged with the light pipes 198. In other embodiments, the sheets 214*a* and/or 214*b* are not adhered, otherwise secured, or engaged with the light pipes 198.

Figure 5:
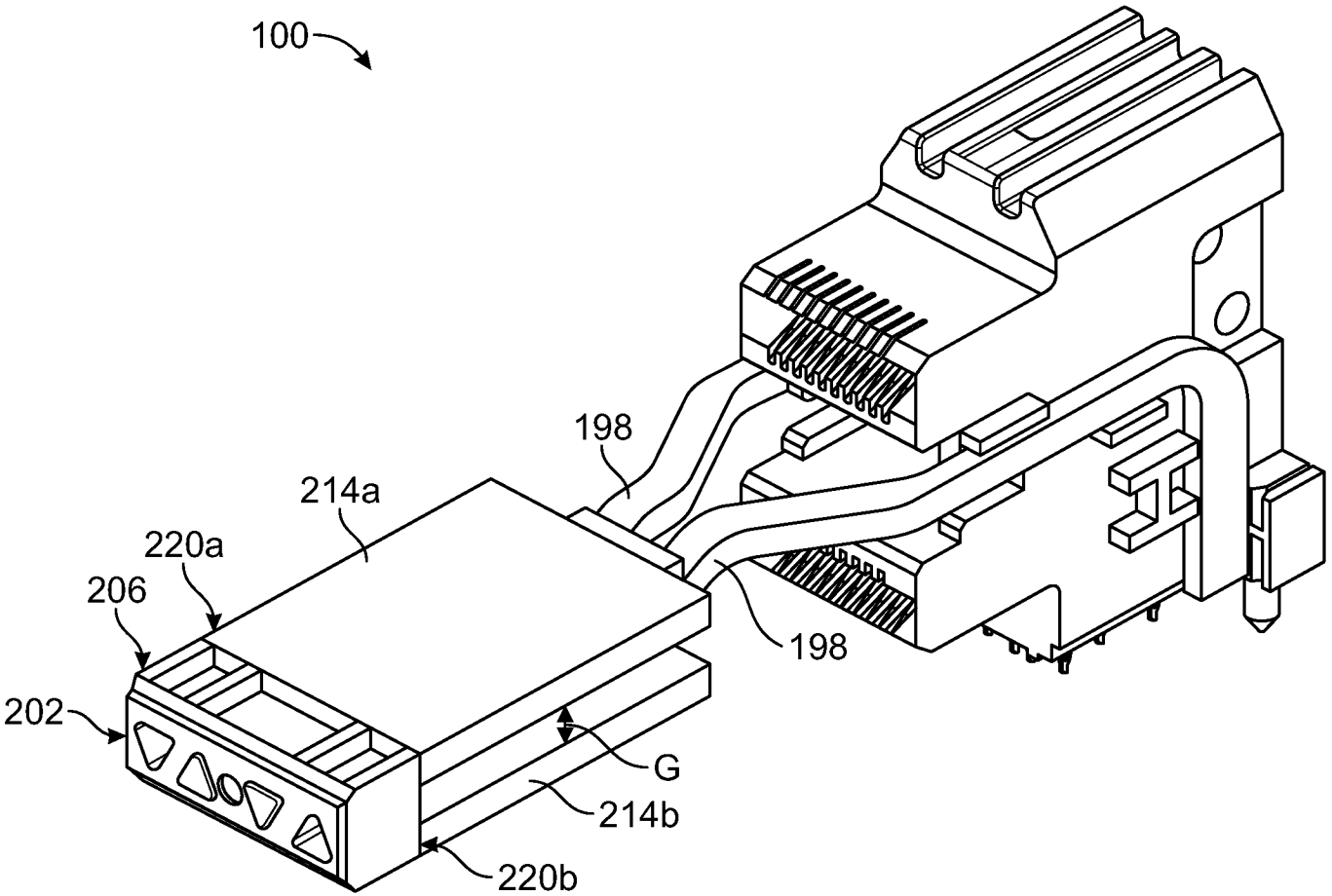
FIG. 5 is a perspective view of another portion of the electrical connector assembly shown in FIG. 1.

The sheets 214*a* and/or 214*b* of the RF absorber 214 can be positioned over the light pipes 198 before being positioned within the channel 190 or can be positioned within the channel 190 before the light pipes 198 are routed into the channel 190. FIG. 5 is a perspective view of another portion of the electrical connector assembly 100. FIG. 5 illustrates the RF absorber sheets 214*a* and 214*b* positioned over the light pipes 198 before the sheets 214*a* and 214*b* are positioned within the channel 190 (FIGS. 3 and 4) of the separator member 122 (FIGS. 1, 3, 4, and 6). The sheets 214*a* and 214*b* are positioned over the light pipes 198 such that the light pipes 198 extend within the gap G between the sheets 214*a* and 214*b*. The ends 220*a* and 220*b* of the sheets 214*a* and 214*b*, respectively are engaged with the body 206 of the light pipe organizer 202. Once arranged as shown in FIG. 5, the light pipe organizer 202, the light pipes 198, and the sheets 214*a* and 214*b* can be assembled into the channel 190 of the separator member 122 to the position shown in FIGS. 3 and 4.

Figure 6:
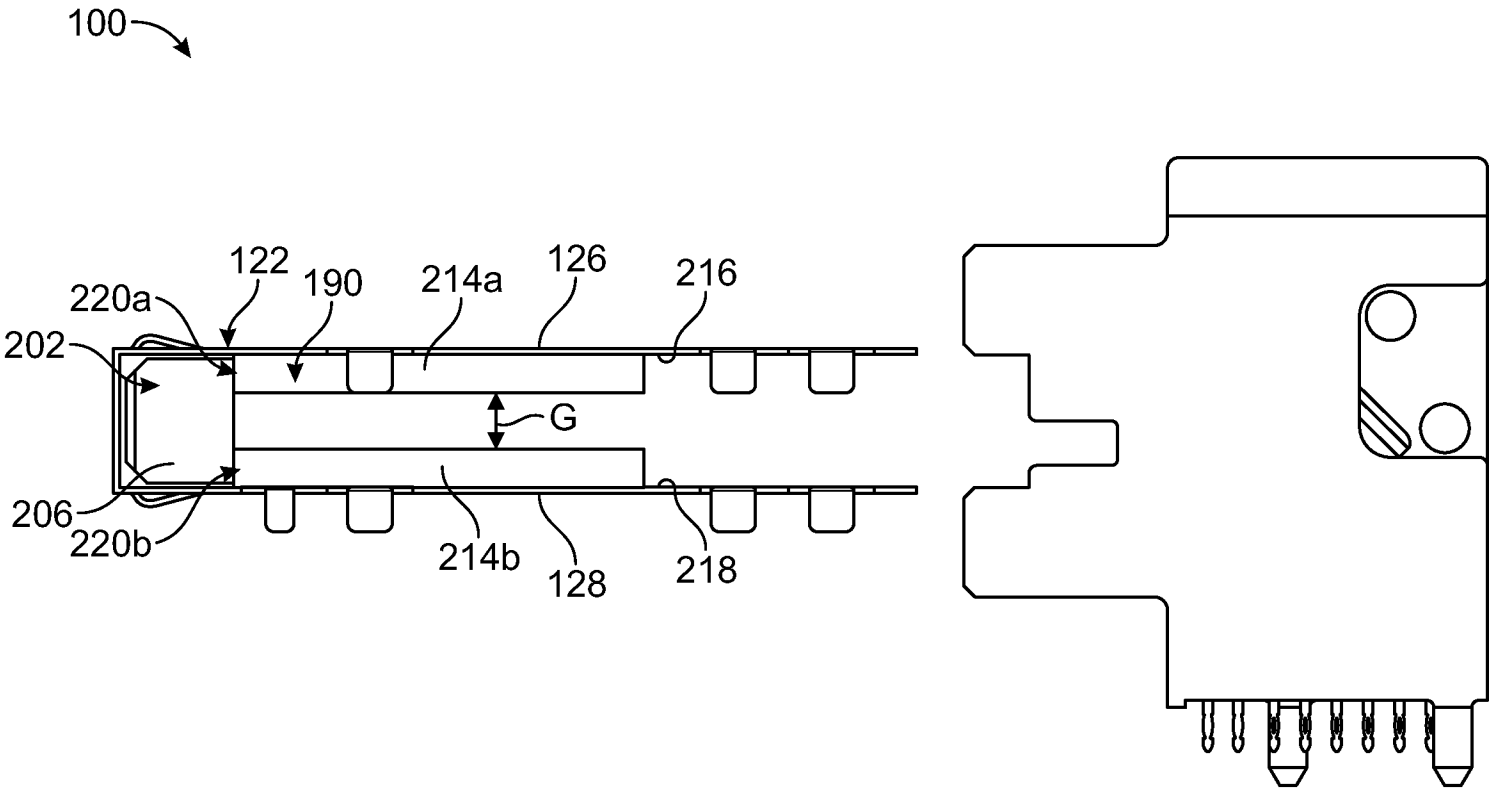
FIG. 6 is a side elevational view of another portion of the electrical connector assembly shown in FIG. 1.

FIG. 6 is a side elevational view of another portion of the electrical connector assembly 100. FIG. 6 illustrates the RF absorber sheets 214*a* and 214*b* positioned within the channel 190 of the separator member 122. The sheets 214*a* and 214*b* are positioned within the channel 190 such that the sheets 214*a* and 214*b* extend on the interior faces 216 and 218 of the upper and lower plates 126 and 128, respectively. The ends 220*a* and 220*b* of the sheets 214*a* and 214*b*, respectively are engaged with the body 206 of the light pipe organizer 202. The light pipes 198 (FIGS. 3-5) can then be routed into the gap G between the sheets 214*a* and 214*b*, and thus the channel 190, to the positions shown in FIGS. 3 and 4. In some alternative embodiments, the light pipes 198 are not routed into the gap G between the sheets 214*a* and 214*b* because the light pipe assembly 200 is not used with the electrical connector assembly 100 or because the light pipes 198 are routed through and/or along other locations of the electrical connector assembly 100 instead of the channel 190.

Figure 7:
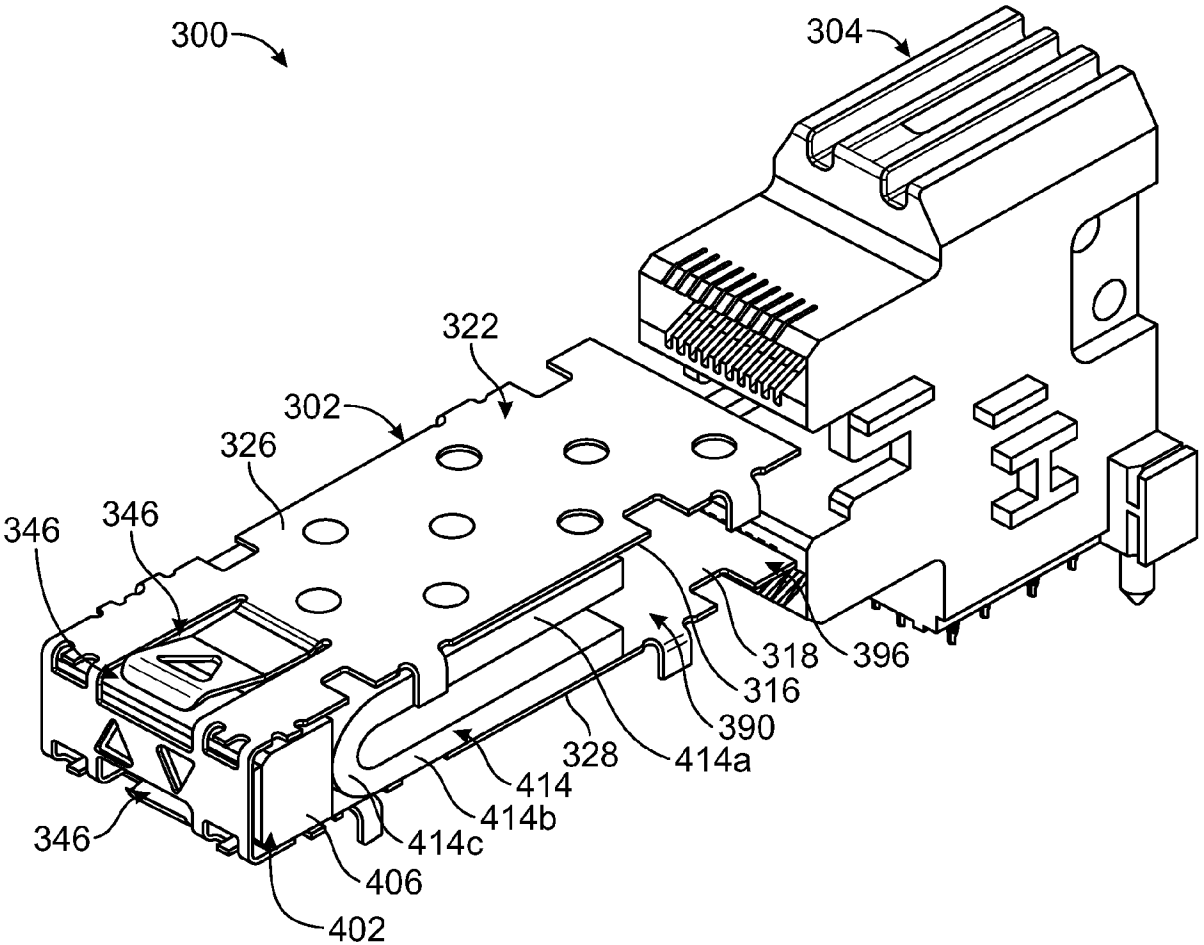
FIG. 7 is a perspective view of another exemplary embodiment of an electrical connector assembly.

FIG. 7 is a perspective view of a portion of another exemplary embodiment of an electrical connector assembly 300. FIG. 7 illustrates another exemplary embodiment of an RF absorber 414. The electrical connector assembly 300 includes a shielding cage member 302 and a receptacle connector 304 received in the cage member 302. The cage member 302 includes a separator member 322 having an upper plate 326, a lower plate 328, and a channel 390 defined between the plates 326 and 328. FIG. 7 illustrates an embodiment wherein light pipes are not used with the assembly 300 or wherein light pipes are routed through and/or along other locations of the electrical connector assembly 300 instead of the channel 390.

Figure 8:
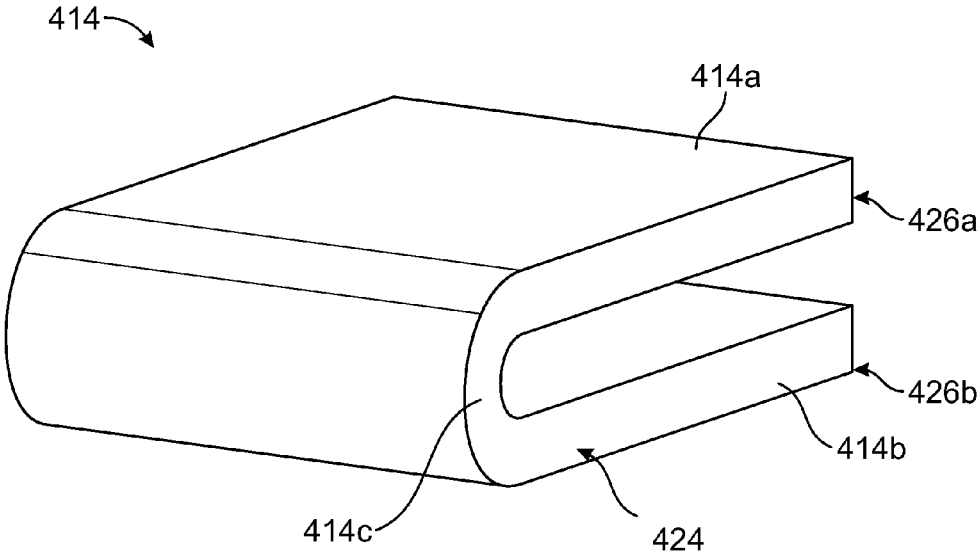
FIG. 8 is a perspective view of an exemplary embodiment of an RF absorber of the electrical connector assembly shown in FIG. 7.

FIG. 8 is a perspective view of an exemplary embodiment of the RF absorber 414. The RF absorber 414 includes a U-shaped body 424 having two sheets 414*a* and 414*b* that are interconnected at a bend wall 414*c*. The body 424 is folded about the bend wall 414*c* to define the U-shape. The bend wall 414*c* defines an end of the RF absorber 414. The sheets 414*a* and 414*b* extend from the bend wall 414*c* to respective ends 426*a* and 426*b*. The RF absorber 414 is manufactured from an EMI absorbent material for reducing or eliminating the amount of EMI emitted from the channel 390. Each sheet 414*a* and 414*b* may be referred to herein as a "first sheet" and/or a "second sheet".

Referring again to FIG. 7, the RF absorber 414 is positioned within the channel 390 of the separator member 322. The sheets 414*a* and 414*b* extend on the upper plate 326 and the lower plate 328, respectively, of the separator member 322. Specifically, the RF absorber sheets 414*a* and 414*b* extend on interior faces 316 and 318 of the upper and lower plates 326 and 328, respectively. Optionally, the bend wall 414*c* of the RF absorber 414 is engaged with a body 406 of a light pipe organizer 402 that is received within the channel 390 of the separator member 322. The sheets 414*a* and 414*b* extend from the bend wall 314*c* toward a rear end 396 of the channel 390. In the exemplary embodiment, the RF absorber 414 extends from the body 406 of the light pipe organizer 402 toward the rear end 396 of the channel 390. As can be seen in FIG. 7, the sheets 414*a* and 414*b* extend along the upper plate 326 and the lower plate 328, respectively, rearward of a corresponding latch clearance 346 of the respective plate 326 and 328.

The bend wall 414*c* of the RF absorber sheets 414 is optionally adhered to the body 406 of the light pipe organizer 402, such as, but not limited to, using any adhesive, using an adhesive backing on the bend wall 414*c*, and/or the like. Alternative securing means may be used in alternative embodiments to secure the bend wall 414*c* to the body 406 of the light pipe organizer 402. In some embodiments, the bend wall 414*c* is not adhered or otherwise secured to the body 406 of the light pipe organizer 402, but rather is merely engaged with the body 406 of the light pipe organizer 402. In other embodiments, the bend wall 414*c* is not adhered, otherwise secured, or engaged with the body 406 of the light pipe organizer 402.

Figure 9:
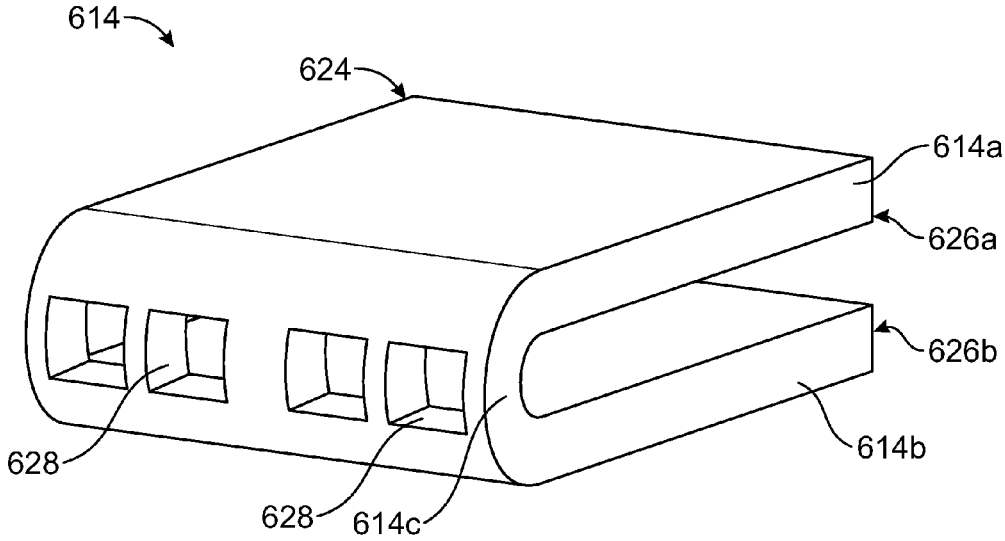
FIG. 9 is a perspective view of another exemplary embodiment of an RF absorber.

FIG. 9 is a perspective view of another exemplary embodiment of an RF absorber 614. The RF absorber 614 is substantially similar to the RF absorber 414 (FIGS. 7 and 8) except the RF absorber 614 is configured to be positioned within a channel 590 (FIG. 10) of a separator member 522 (FIG. 10) having one or more light pipes 598 (FIG. 10) extending therein. The RF absorber 614 is manufactured from an EMI absorbent material for reducing or eliminating the amount of EMI emitted from the channel 590.

The RF absorber 614 includes a U-shaped body 624 having two sheets 614*a* and 614*b* that are interconnected at a bend wall 614*c*. The body 624 is folded about the bend wall 614*c* to define the U-shape. The bend wall 614*c* defines an end of the RF absorber 614. The sheets 614*a* and 614*b* extend from the bend wall 614*c* to respective ends 626*a* and 626*b*. The bend wall 614*c* includes one or more openings 628 that extend through the bend wall 614*c*. As will be described below, each opening 628 is configured to receive one or more corresponding light pipes 598 therethrough. Although four are shown, the bend wall 614*c* may include any number of openings 628, wherein each opening 628 may receive any number of light pipes 598 therethrough. Each sheet 614*a* and 614*b* may be referred to herein as a "first sheet" and/or a "second sheet".

Figure 10:
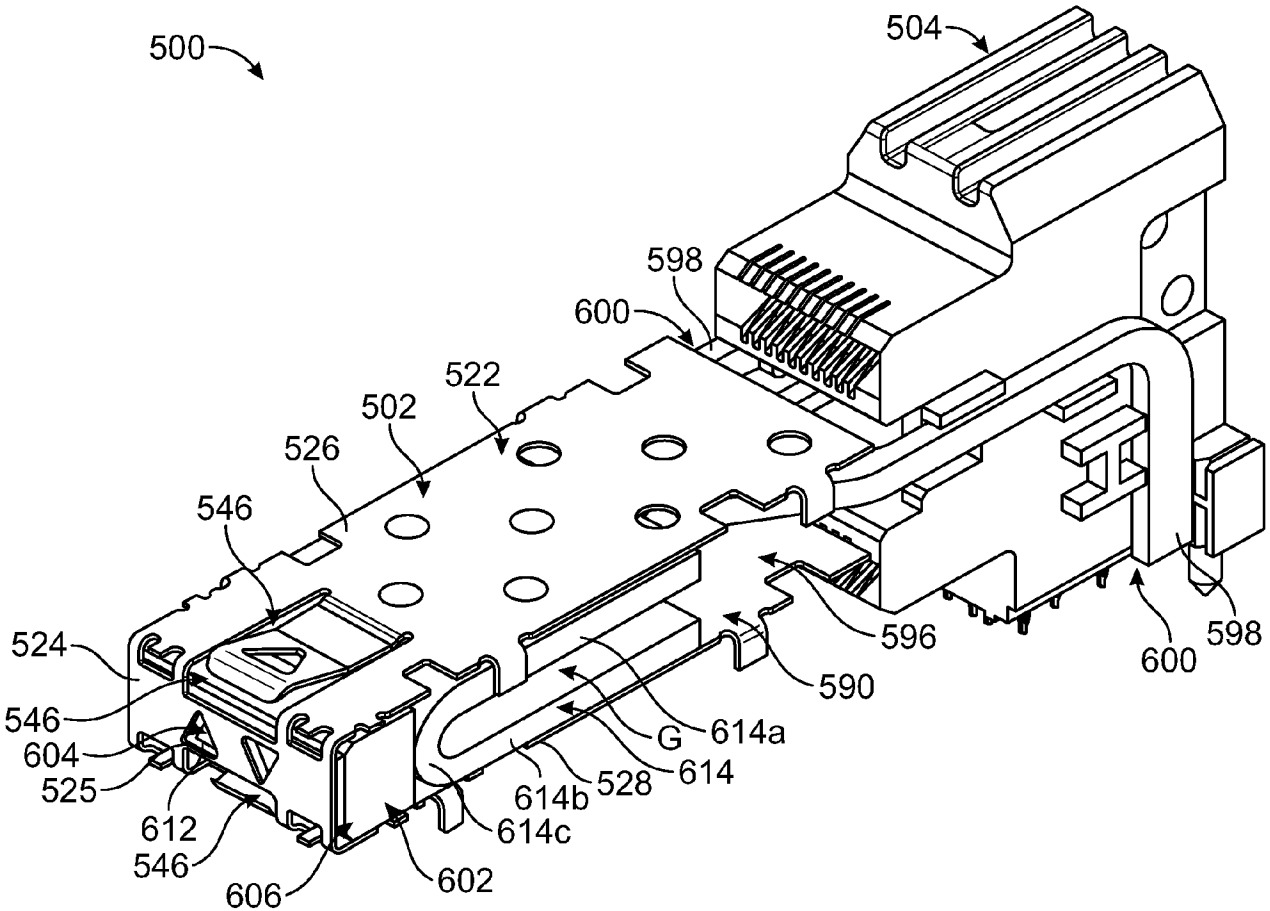
FIG. 10 is a perspective view of an exemplary embodiment of an electrical connector assembly within which the RF absorber shown in FIG. 9 may be implemented.

FIG. 10 is a perspective view of a portion of another exemplary embodiment of an electrical connector assembly 500. The RF absorber 614 may be implemented within the electrical connector assembly 500. The electrical connector assembly 500 includes a shielding cage member 502 and a receptacle connector 504 received in the cage member 502. The cage member 502 includes the separator member 522, which includes an upper plate 526, a lower plate 528, and the channel 590, which is defined between the plates 526 and 528.

The electrical connector assembly 100 includes a light pipe assembly 600. The light pipe assembly 600 includes one or more of the light pipes 598 and a light pipe organizer 602. The light pipe organizer 602 is positioned within the channel 590. Light pipe openings 612 of the light pipe organizer 602 are aligned with light pipe openings 525 that extend through a front wall 524 of the separator member 522.

The RF absorber 614 is positioned within the channel 590 of the separator member 522. The sheets 614*a* and 614*b* extend on the upper plate 526 and the lower plate 528, respectively, of the separator member 522. Optionally, the bend wall 614*c* of the RF absorber 614 is engaged with a body 606 of the light pipe organizer 602. The sheets 614*a* and 614*b* extend from the bend wall 614*c* toward a rear end 596 of the channel 590. In the exemplary embodiment, the RF absorber 614 extends from the body 606 of the light pipe organizer 602 toward the rear end 596 of the channel 590. The sheets 614*a* and 614*b* extend along the upper plate 526 and the lower plate 528, respectively, rearward of a corresponding latch clearance 546 of the respective plate 526 and 528.

The sheets 614*a* and 614*b* are positioned over the light pipes 598 such that the light pipes 598 are routed through a gap G between the sheets 614*a* and 614*b*. Ends 604 of the light pipes 598 extend through the corresponding openings 628 (FIG. 9) of the RF absorber 614. The ends 604 of the light pipes 598 are held by the light pipe organizer 602 such that the ends 604 are held within the corresponding light pipe openings 612. Because the light pipe openings 612 are aligned with the light pipe openings 525 of the separator member 522, the light pipes 598 are configured to emit light through the openings 525.

Figure 11:
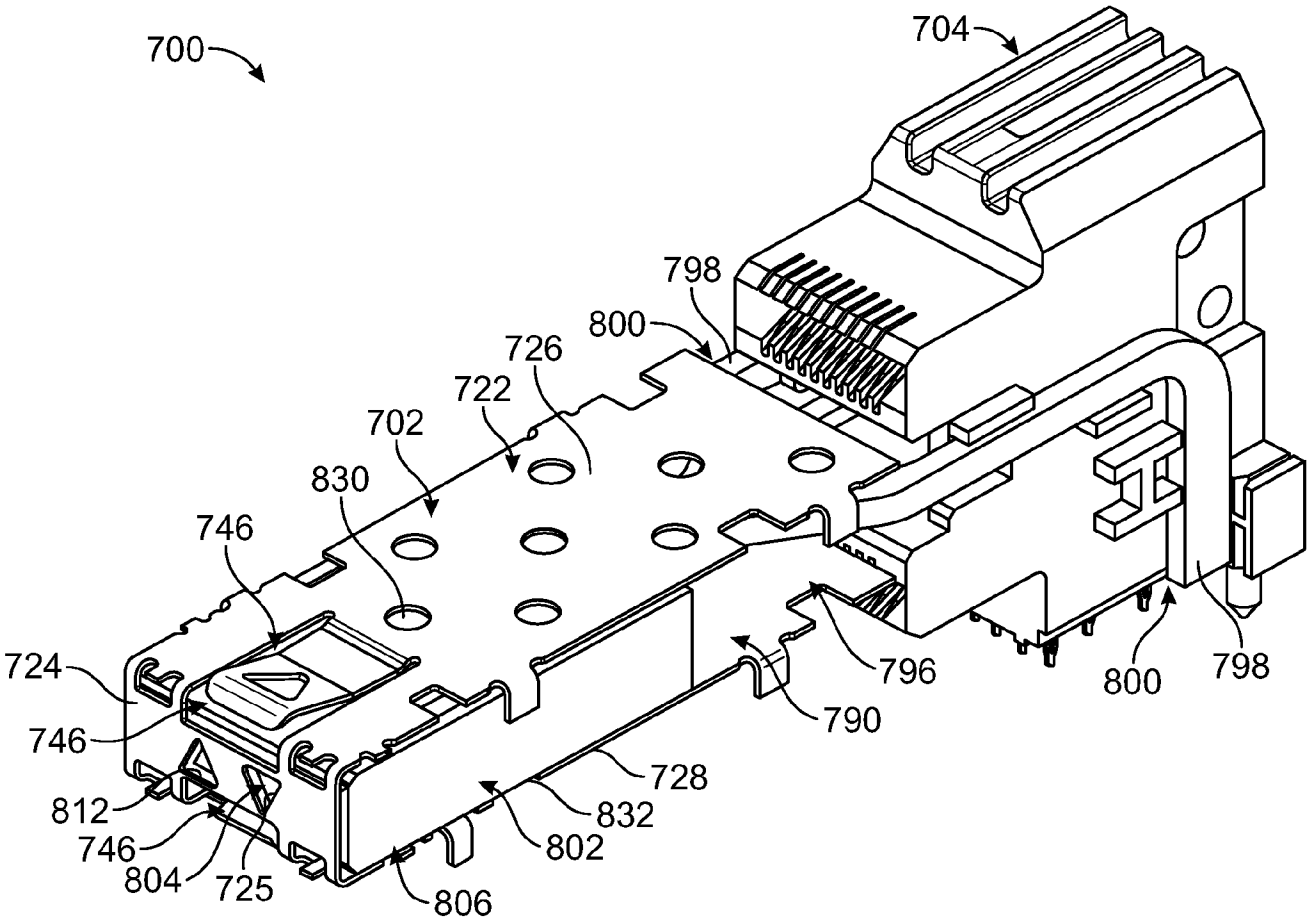
FIG. 11 is a perspective view of another exemplary embodiment of an electrical connector assembly.

FIG. 11 is a perspective view of a portion of another exemplary embodiment of an electrical connector assembly 700. FIG. 11 illustrates an exemplary embodiment of a light pipe organizer 802 that includes an RF absorber material. The electrical connector assembly 700 includes a shielding cage member 702 and a receptacle connector 704 received in the cage member 702. The cage member 702 includes a separator member 722 having a front wall 724, an upper plate 726, a lower plate 728, and a channel 790 defined between the plates 726 and 728.

The electrical connector assembly 700 also includes a light pipe assembly 800. The light pipe assembly 800 includes one or more light pipes 798 and the light pipe organizer 802. Each light pipe 798 includes an end 804. Although two are shown, the light pipe assembly 800 may include any number of light pipes 798.

Figure 12:
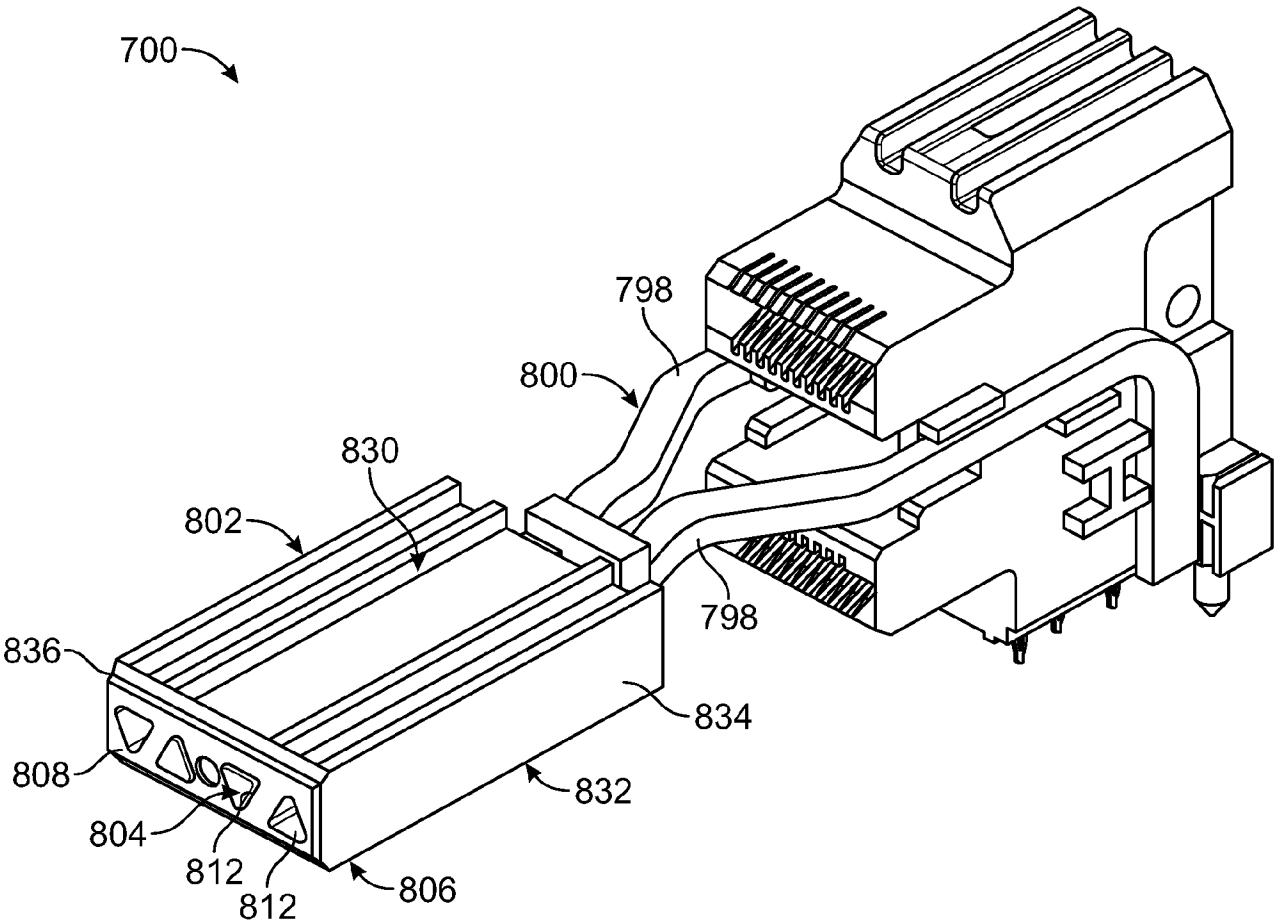
FIG. 12 is a perspective view of another portion of the electrical connector assembly shown in FIG. 11.

FIG. 12 is a perspective view of another portion of the electrical connector assembly 700. The light pipe organizer 802 includes a body 806 having a front face 808, an upper wall 830, a lower wall 832, and side walls 834 and 836. The front face 808 and the side walls 834 and 836 connect the upper wall 830 to the lower wall 832. The light pipe organizer 802 includes one or more light pipe openings 812 that extend through the front face 808. Although shown as having the general shape of a parallelepiped, the body 806 of the light pipe organizer 802 may additionally or alternatively include any other shape, which may or may not be complementary with the shape of the channel 790. Each of the walls 830 and 832 may be referred to herein as a "first wall" and/or a "second wall".

The body 806 of the light pipe organizer includes an RF absorber material. The RF absorber material of the body 806 is configured to be EMI absorbent for reducing or eliminating the amount of EMI emitted from the channel 790. In the exemplary embodiment, the body 806 of the light pipe organizer 802 is formed entirely from the RF absorber material. Specifically, in the exemplary embodiment, the front face 808, the upper wall 830, the lower wall 832, the side wall 834, and the side wall 836 are each formed entirely from the RF absorber material. But, the body 806 is not limited to being formed entirely from the RF absorber material. Nor is the front face 808 or any of the walls 830, 832, 834, or 836 limited to being formed entirely from the RF absorber material. Rather, any portion(s) and/or amount of the body 806 of the light pipe organizer 802 may be formed from the RF absorber material. For example, in some embodiments, the upper wall 830 and the lower wall 832 are formed from the RF absorber material, while the side walls 834 and 836 are not formed from the RF absorber material.

The body 806 of the light pipe organizer 802 may be formed using any process, method, structure, equipment, means, and/or the like, such as, but not limited to, molding, casting, machining, and/or the like. One example of the body 806 of the light pipe organizer 802 is a molded light pipe organizer that is molded (e.g., injection molded) from the RF absorber material.

The body 806 of the light pipe organizer includes one or more chambers (not shown) that receive one or more corresponding light pipes 798 therein. The body 806 may include any number of chambers, wherein each chamber may receive the number of light pipes 798 therein. The light pipes 798 are held by the light pipe organizer 892 such that the end 804 of each light pipe 798 is held within a corresponding light pipe opening 812 of the light pipe organizer 802.

Referring again to FIG. 11, the light pipe organizer 802 is positioned within the channel 790 of the separator member 722. The upper wall 830 and the lower wall 832 extend along the upper plate 726 and the lower plate 728, respectively, of the separator member 722. In the exemplary embodiment, the upper wall 830 and the lower wall 832 constitute surface wave absorbers, which are oriented parallel to the direction of EMI propagation. Optionally, the upper wall 830 and/or the lower wall 832 is engaged with, adhered to, and/or otherwise secured to the respective plate 726 and 728. In some embodiments, the body 806 of the light pipe organizer 802 is received within the channel 790 with an interference fit. In some embodiments, the light pipe organizer 802 functions as a plug wherein the RF absorber material of the body 806 is positioned within the channel 790 to substantially or entirely fill an area of the channel 790.

The body 806 of the light pipe organizer 802 extends from a front wall 724 of the separator member 722 toward a rear end 796 of the channel 790. As can be seen in FIG. 11, the upper wall 830 of the body 806 overlaps the corresponding latch clearance 746 of the upper plate 726 of the separator member 722. Although not visible in FIG. 11, it should be apparent that the lower wall 832 of the body 806 of the light pipe organizer 802 overlaps the corresponding latch clearance 746 of the lower plate 728. The upper wall 830 and the lower wall 832 also each extend along the upper plate 726 and the lower plate 728, respectively, rearward of the corresponding latch clearance 746.

The light pipe openings 812 of the light pipe organizer 802 are aligned with light pipe openings 725 that extend through the front wall 724 of the separator member 722, as can be seen in FIG. 11. Accordingly, the end 804 of each light pipe 798 is aligned with the corresponding light pipe opening 725 of the separator member 722 such that the light pipes 798 are configured to emit light through the openings 725.

FIG. 13 illustrates a pluggable module 106 for use with the electrical connector assemblies 100 (FIGS. 1 and 3-6), 300 (FIG. 7), 500 (FIG. 10), and 700 (FIGS. 11 and 12). In the exemplary embodiment, the pluggable module 106 constitutes a small form-factor pluggable (SFP) module having a circuit card 902 at a mating end 903 thereof for interconnection into the slots 180 and/or 182 (FIG. 2) and into interconnection with the contacts 184 and/or 186 (FIG. 2) therein. The pluggable module 106 would further include an electrical interconnection within the module to an interface at end 904, such as, but not limited to, a copper interface in the way of a modular jack, or to a fiber optic connector for further interfacing. The pluggable module 106 may also include grounding tabs 906 and 908, and a raised embossment 910. The embossment 910 latches into the triangular shaped opening of the latch 144 (FIG. 1). Other types of pluggable modules or transceivers may be utilized in alternative embodiments.

The embodiments described and/or illustrated herein may provide an electrical connector assembly having a reduced amount of EMI emissions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a shielding cage member having an upper port and a lower port configured to receive pluggable modules therein, the cage member having side walls that extend along sides of the upper and lower ports and a separator member that extends between the side walls and between the upper and lower ports, the separator member having an upper plate and a lower plate with a channel therebetween;

a light pipe organizer positioned within the channel; and an RF absorber positioned within the channel in engagement with the light pipe organizer, the RF absorber reducing an amount of electromagnetic interference (EMI) emitted from the channel, wherein the RF absorber comprises a U-shape defined by first and second sheets that are interconnected at a bend wall, the bend wall being engaged with the light pipe organizer.

2. The electrical connector assembly of claim 1, wherein the channel extends a length from a front end to a rear end, the cage member including a front, the upper port and the lower port being open through the front of the cage member, the front end of the channel being positioned at the front of the cage member, the light pipe organizer being positioned within the channel at the front end, the RF absorber comprising a sheet that extends from the light pipe organizer toward the rear end of the channel.

3. The electrical connector assembly of claim 1, wherein the RF absorber comprises a sheet extending on at least one of the upper plate or the lower plate.

4. The electrical connector assembly of claim 1, wherein the RF absorber comprises a surface wave absorber arranged generally parallel to a direction of EMI propagation through the separator member.

5. The electrical connector assembly of claim 1, wherein the RF absorber comprises a first sheet extending on the upper plate and a second sheet extending on the lower plate, a gap separating the first and second sheets.

6. The electrical connector assembly of claim 1, wherein the bend wall comprising an opening extending therethrough, the opening being configured to receive a light pipe therethrough.

7. The electrical connector assembly of claim 1, wherein at least one of the upper plate or the lower plate includes a latch and a latch clearance, the RF absorber extending along at least one of the upper plate or the lower plate rearward of the corresponding latch clearance.

8. The electrical connector assembly of claim 1, wherein the RF absorber is fabricated from an elastomeric material.

9. The electrical connector assembly of claim 1, further comprising a light pipe received in the channel, the light pipe comprising an end that is held by the light pipe organizer.

10. An electrical connector assembly comprising:

a shielding cage member having an upper port and a lower port configured to receive pluggable modules therein, the cage member having side walls that extend along sides of the upper and lower ports and a separator member that extends between the side walls and between the upper and lower ports, the separator member having an upper plate and a lower plate with a channel therebetween;

a receptacle connector received in the cage member, the receptacle connector being accessible through the upper port and the lower port and being configured to be electrically connected to the pluggable modules;

an RF absorber positioned within the channel, the RF absorber reducing an amount of electromagnetic interference (EMI) emitted from the channel, the RF absorber comprising a U-shaped body that is defined by first and second sheets that are interconnected at a bend wall.

11. The electrical connector assembly of claim 10, wherein the bend wall comprises an opening extending therethrough, the opening being configured to receive a light pipe therethrough.

12. The electrical connector assembly of claim 10, further comprising a light pipe organizer positioned within the channel of the separator member, the bend wall being engaged with the light pipe organizer.

13. The electrical connector assembly of claim 10, wherein the RF absorber comprises a surface wave absorber arranged generally parallel to a direction of EMI propagation through the separator member.

* * * * *